US009118154B2

(12) United States Patent
Yu et al.

(10) Patent No.: US 9,118,154 B2
(45) Date of Patent: Aug. 25, 2015

(54) MINIATURIZED CARD EDGE CONNECTOR WITH ASSEMBLED TERMINAL MODULE

(71) Applicant: HON HAI PRECISION INDUSTRY CO., LTD., New Taipei (TW)

(72) Inventors: Hung-Chi Yu, New Taipei (TW); Zhen-Hua Wang, Kunshan (CN); Feng-Lan Liu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 138 days.

(21) Appl. No.: 14/052,613

(22) Filed: Oct. 11, 2013

(65) Prior Publication Data

US 2014/0106622 A1 Apr. 17, 2014

(51) Int. Cl.
*H01R 13/62* (2006.01)
*H01R 12/72* (2011.01)
*H01R 13/514* (2006.01)

(52) U.S. Cl.
CPC ..... *H01R 12/722* (2013.01); *H01R 12/724* (2013.01); *H01R 13/514* (2013.01)

(58) Field of Classification Search
CPC ..... H01R 23/7005
USPC ..... 439/326, 637
See application file for complete search history.

(56) References Cited

U.S. PATENT DOCUMENTS 6,666,702 B1 * 12/2003 Pickles ..... 439/328
8,858,237 B2 * 10/2014 Hsu et al. ..... 439/60
8,894,438 B2 * 11/2014 Schmitt et al. ..... 439/540.1

FOREIGN PATENT DOCUMENTS

TW M336576 7/2008

* cited by examiner

*Primary Examiner* — Phuong Dinh
(74) *Attorney, Agent, or Firm* — Wei Te Chung; Ming Chieh Chang

(57) ABSTRACT

A card edge connector includes an insulative housing, first terminals and a terminal module embedded with second terminals. The housing defines a front face and a rear face, and a card receiving slot recessed from the front face to divided the housing to a first side wall and a second side wall. The first terminals are inserted in the first side wall from the rear face, the first terminals include retaining portions fixed in the first side wall, contacting portions protruding into the card receiving slot and board connecting portions. The second terminals include retained portions embedded in the terminal module, contacting portions and board connecting portions. The terminal module is assembled to the front face of the housing, the contacting portions of the second terminals are arranged along the second side wall and project in the card receiving slot.

7 Claims, 4 Drawing Sheets

MINIATURIZED CARD EDGE CONNECTOR WITH ASSEMBLED TERMINAL MODULE

BACKGROUND OF THE INVENTION

1. Field of the Invention

The present invention relates to a card edge connector, and more particularly to a miniaturized card edge connector.

2. Description of the Related Art

TW Pat. Issued No. M336576 issued to Bellwether Incorporated on Jul. 11, 2008, discloses a card edge connector, the card edge connector includes an insulative housing, a plurality of terminals fixed to the housing, and a spacer assembled to the housing. The housing defines an upper face and a bottom face opposite to each other, the spacer is assembled to a recess disposed at a bottom portion of the housing from the bottom face thereof for retaining soldering portions of the terminals. However the housing should be thick enough to set such a recess for receiving the spacer therein which is not benefit to miniaturization of the card edge connector.

Therefore, an improved card edge connector is desired to overcome the disadvantages of the related arts.

BRIEF SUMMARY OF THE INVENTION

An object of the present invention is to provide a card edge connector which can reduce the height thereof In order to achieve above-mentioned object, a card edge connector comprising: a longitudinal insulative housing defining a front face and a rear face opposite to the front face, and a card receiving slot recessed from the front face to the rear face and extending along a longitudinal direction of the insulative housing to divide the insulative housing into a first side wall and a second side wall opposite to each other; a plurality of first terminals inserted in the first side wall from the rear face, the first terminals comprising retaining portions fixed in the first side wall, contacting portions protruding into the card receiving slot and board connecting portions; and a terminal module embodied with a plurality of second terminals therein, the second terminal comprising retained portions embedded in the terminal module, contacting portions and board connecting portions; wherein the terminal module is assembled to the front face of the insulative housing, the contacting portions of the second terminals are arranged along the second side wall and project in the card receiving slot.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
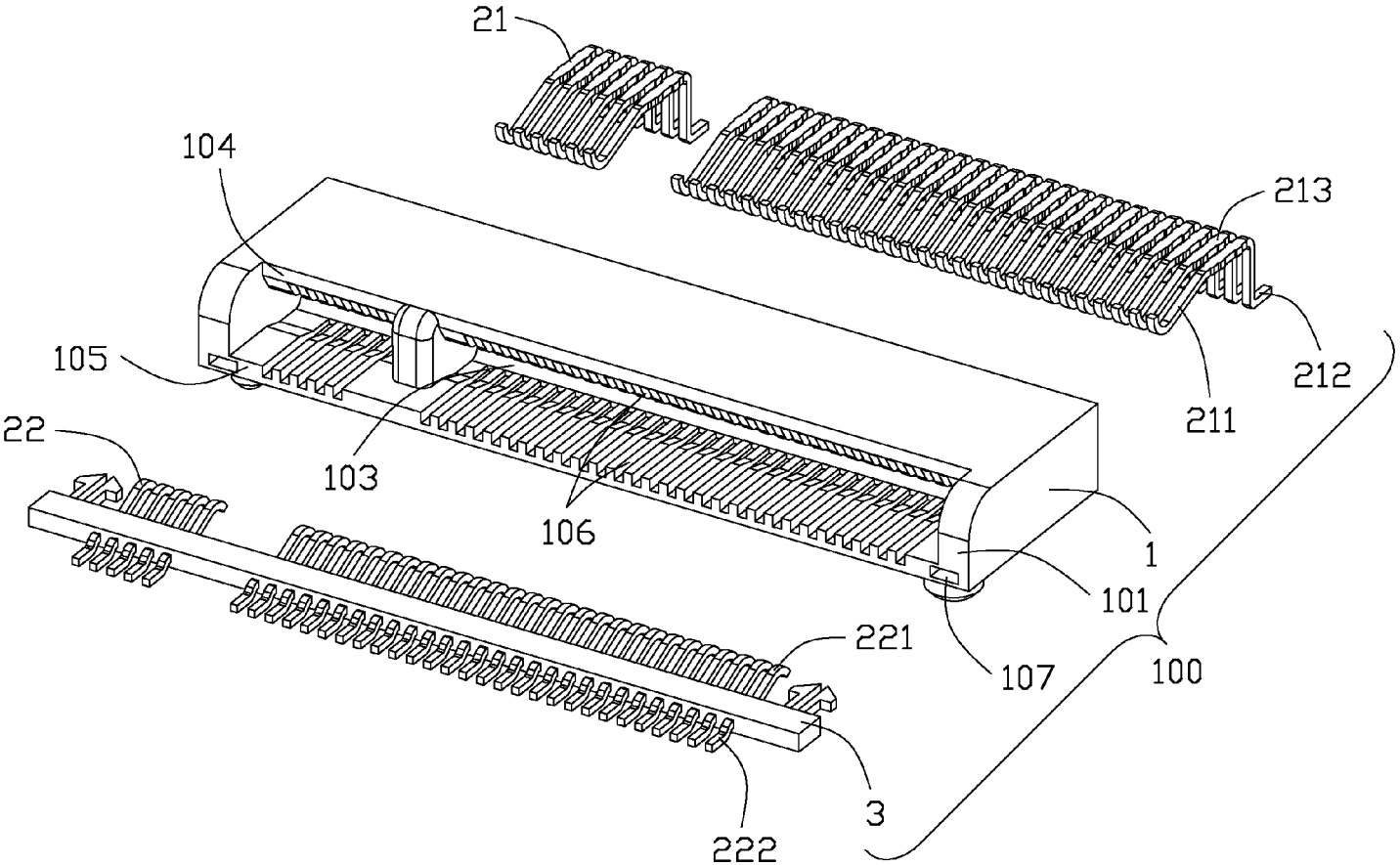
FIG. 1 is an exploded perspective view of card edge connector in accordance with the present invention.
Figure 2:
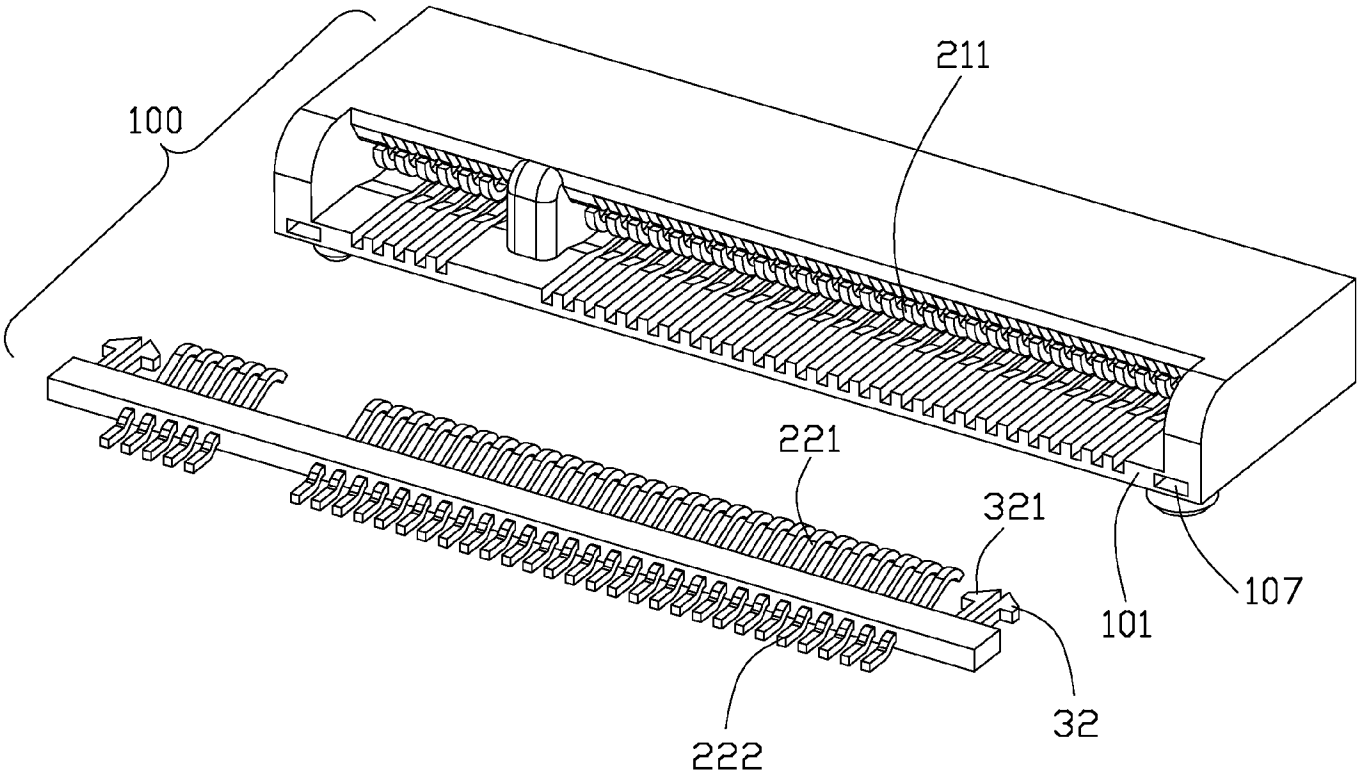
FIG. 2 is a perspective view of the card edge connector with a terminal module separated from the housing.

Reference will now be made to the drawing figures to describe a preferred embodiment of the present invention in detail. FIG. 1 and FIG. 2 illustrate a card edge connector 100, which includes an insulative housing 1, a plurality of first terminals 21 fixed to the housing 1 and a terminal module 3 embedded with a plurality of second terminals 22 therein and assembled to the housing 1.

The housing 1 is longitudinal with a front face 101, a rear face opposite to the front face 101, and a card receiving slot 103 recessed from the front face 101 to the rear face to divide the housing into a first side wall 104 and a second side wall 105 at two opposite sides of the card receiving slot 103. The first and second side walls 104, 105 each defines a row of terminal grooves 106 arranged along the longitudinal direction of the connector and communicating with the card receiving slot 103. The terminal grooves 106 at the first side wall 104 and the terminal grooves 106 defined at the second side wall 105 are staggered along the longitudinal direction. A pair of mounting holes 107 is recessed rearwards from the front face 101 and disposed at two ends of the second side wall 105, the terminal grooves 106 defined in the second side wall 105 are disposed between the mounting holes 107.

The first terminals 21 comprise horizontal retaining portion 213, contacting portions 211 cantilevered from the retaining portion and board-connecting portion 212. Combination with FIG. 4, the first terminals are inserted and retained into the terminals grooves 106 of the first side wall 104, with retaining portions 213 fixed to the first side wall 104, contacting portions 211 protruding to the card receiving slot 103 and connecting portions 212 extending out of the rear face of housing 1 for soldering onto a printed circuit board (not shown).

The second terminals 22 are embedded in the terminal module 3, with board connecting portions 222 horizontally extending out of a front face of the terminal module 3 and contacting portions 221 extending out of a rear face of the terminal module 3. The terminal module 3 further defines a pair of mounting legs 32 horizontally projecting rearwards from opposite ends thereof Each of the mounting legs 32 is in a fork shape with a hook 321. Please notes, the mounting legs 32 are lower than the contacting portions 221 of the second terminals 22.

Figure 4:
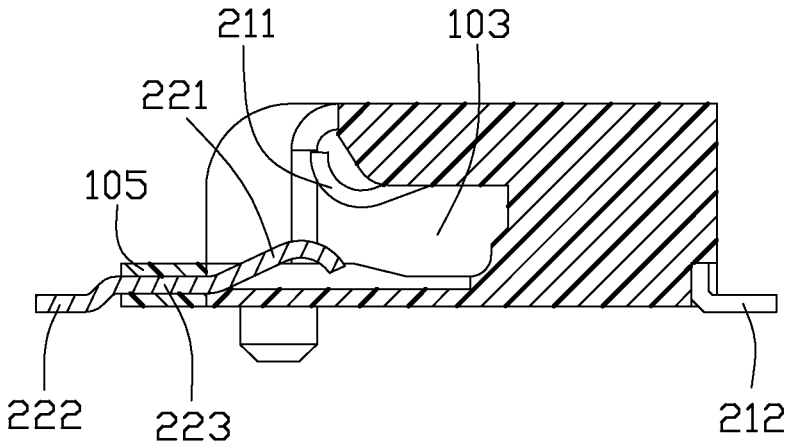
FIG. 4 is a cross-sectional view of the card edge connector taken along line 4-4 in FIG. 3.

The terminal module 3 is movably assembled to the housing 1 by the mounting legs 32 locked with the mounting holes 107, the contacting portions 221 of the second terminals 22 received in the terminal grooves 106 at the second side wall 105 and projecting into the card receiving cavity 103. As shown in FIG. 4, retaining portions 223 are embedded in the terminal module, an upper face of the terminal module is aligned with the upper face of the second side wall. The terminal module 3 is disposed in front of the front face 101 of the housing 1 and provides a slim thickness with second side wall 105, which can make the housing 1 lower in height. The height of the mounting legs 32 is lower than that of the mounting hole 107, so the mounting legs 32 can float in the mounting holes 107 along an up to down direction, and the board connecting portions 222 of the second terminals 22 can be adjust to be at a same plane with the connecting portions 212 of the first terminals 21.

Figure 3:
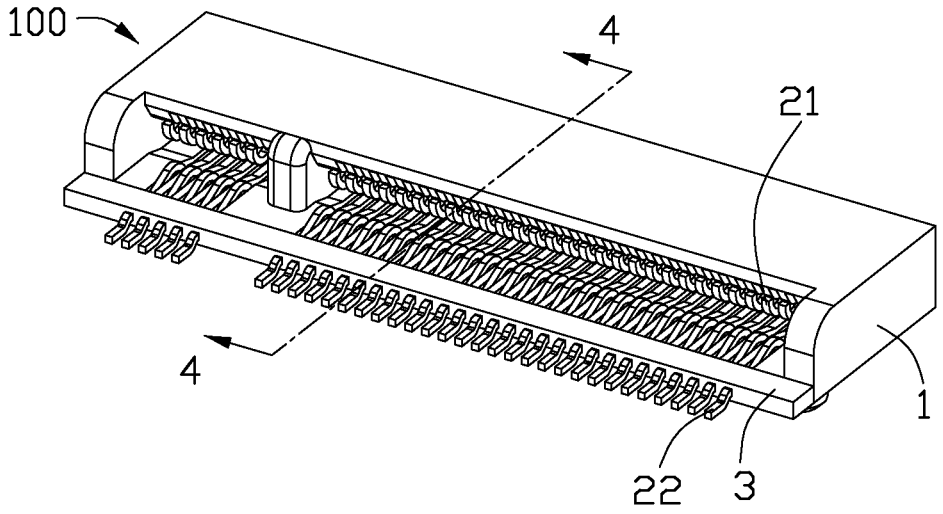
FIG. 3 is a perspective view of the card edge connector shown in FIG. 1.

In present technology, the depth of the terminal grooves 106 recessed at the housing need to be deep enough to receive the whole second terminals, so the strength of the housing may be influenced. In this invention, the second terminals 22 are insert-molded in the terminal module 3 with contacting portions 221 running through the terminal grooves 106 at the second side wall 105, that's to say, the terminal grooves 106 can be shallow, so the intensity of the housing 1 is strengthened. And the terminal module 3 is assembled in front of the housing 1, which can reduce the height of the card edge 100 (refer to FIG. 3)

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector comprising:

a longitudinal insulative housing defining a front face and a rear face opposite to the front face, and a card receiving slot recessed from the front face to the rear face and extending along a longitudinal direction of the insulative housing to divide the insulative housing into a first side wall and a second side wall opposite to each other;

a plurality of first terminals inserted in the first side wall from the rear face, the first terminals comprising retaining portions fixed in the first side wall, contacting portions protruding into the card receiving slot and board connecting portions; and a terminal module embodied with a plurality of second terminals therein, the second terminal comprising retained portions embedded in the terminal module, contacting portions and board connecting portions;

wherein the terminal module is assembled to the front face of the insulative housing, and the contacting portions of the second terminals are arranged along the second side wall and project in the card receiving slot;

wherein the second side wall defines a plurality of terminal grooves, the contacting portions of the second terminals are received in the terminal grooves at the second side wall;

wherein the insulative housing defines a pair of mounting holes disposed at the front face thereof, the terminal module defines a pair of mounting legs, the mounting legs lock into the mounting holes;

wherein a height of the mounting legs is lower than that of the mounting holes.

2. The card edge connector as described in claim 1, wherein an upper face of the terminal module is aligned with the upper face of the second side wall.

3. A card edge connector comprising:

an insulating housing defining a card receiving slot opening a front face thereof, an upper wall and a lower wall at opposite side of the card receiving slot, the upper wall and lower wall defining terminal grooves respectively;

a plurality of first terminals retained in the insulating housing, the first terminals comprising retained portions retained in the insulating housing, contacting portions received in the terminal grooves defined at the upper wall and board-connecting portions;

a plurality of second terminals comprising retaining portions, contacting portions received in the terminal grooves defined at the lower wall and board-connecting portions; and an insulating module attached to the front face of the insulating housing, the retained portions of the second terminals retained in the insulating module and the board-connecting portion of the second terminals extending from the insulating module;

wherein the insulating module defines a pair of mounting legs and the insulating housing defines a pair mounting hole at the lower wall, the mounting legs are engaged with the mounting holes;

wherein the mounting legs are movable in the mounting holes along an upper to lower direction of the insulating housing.

4. A card edge connector comprising:

an insulative housing defining opposite upper and lower side walls with therebetween, in a vertical direction, a card receiving space which essentially extends in a longitudinal direction perpendicular to the vertical direction and communicates with an exterior in a front-to-back direction perpendicular to both said vertical direction and said longitudinal direction;

a plurality of upper contacts disposed in the housing with corresponding deflectable contacting sections extending into the card receiving space;

a terminal module including a plurality of lower contacts associatively retained to an insulator with contacting sections extending into the card receiving space; wherein said insulator is discrete from and located in front of a front face of the housing without blocking a front opening of the card receiving space;

wherein an interior surface of the lower side wall defines a plurality of groove in which the lower contacts are received respectively;

wherein said terminal module is assembled to the housing;

wherein said terminal module and said housing are configured to have said terminal module rearwardly assembled to front face of the housing in said front-to-back direction;

further comprising at least one latch to secure said insulator to the housing;

further including another latch, wherein said latch is located around one longitudinal end of the insulator while said another latch is located around the other longitudinal end of the insulator.

5. The card edge connector as claimed in claim 4, wherein a thickness of said insulator is similar to that of the lower side wall in the vertical direction.

6. The card edge connector as claimed in claim 4, wherein a contact point of the contacting section of the upper contact is located behind that of the lower contact in the front-to-back direction.

7. The card edge connector as claimed in claim 4, wherein a thickness of the upper side wall is larger than that of the lower side wall in the vertical direction.

* * * * *